US005556569A

United States Patent [19]

Huang

[11] Patent Number: 5,556,569

[45] Date of Patent: Sep. 17, 1996

[54] NON-CONVENTIONAL OVERBASED MATERIALS

[75] Inventor: Nai Z. Huang, Mayfield Heights, Ohio

[73] Assignee: The Lubrizol Corporation, Wickliffe, Ohio

[21] Appl. No.: 418,046

[22] Filed: Apr. 6, 1995

[51] Int. Cl.[6] ..... C10M 159/00

[52] U.S. Cl. ..... 508/545; 508/569; 508/579; 508/580

[58] Field of Search ..... 252/18, 33, 42.7

[56] References Cited

U.S. PATENT DOCUMENTS

| | | | |
|---|---|---|---|
| Re. 27,582 | 2/1973 | Kahn et al. | 252/32.7 |
| 2,798,852 | 7/1957 | Wiese et al. | 252/42.7 |
| 2,968,642 | 1/1961 | Le Suer | 260/45.75 |
| 2,971,014 | 2/1961 | Mastin | 260/398 |
| 2,989,463 | 6/1961 | Mastin | 252/25 |
| 3,324,733 | 9/1967 | Robbins et al. | 252/33 |
| 3,372,118 | 3/1968 | Rense | 252/42.7 |
| 3,492,231 | 1/1970 | McMillen | 252/33 |
| 3,515,669 | 6/1970 | Le Suer | 252/39 |
| 3,779,922 | 12/1973 | Le Suer | 252/34.7 |
| 3,784,474 | 1/1974 | Brown et al. | 252/51.5 |
| 4,083,792 | 4/1978 | Nnadi | 252/18 |
| 4,751,010 | 6/1988 | Leone et al. | 252/33 |
| 4,954,272 | 9/1990 | Jao et al. | 252/33 |
| 5,011,618 | 4/1991 | Papke et al. | 253/18 |
| 5,108,630 | 4/1992 | Black et al. | 252/18 |
| 5,162,085 | 11/1992 | Cane et al. | 252/18 |

*Primary Examiner*—Jacqueline V. Howard
*Attorney, Agent, or Firm*—David M. Shold; Frederick D. Hunter

[57] ABSTRACT

Organic compounds having at least one hydrocarbyl group and a polar group containing at least one nitrogen, oxygen, or sulfur atom, being free from acidic hydrogen atoms and from functional groups which provide such organic compounds with acidic hydrogen atoms upon hydrolysis, can be overbased by treatment with an metallic base and a low molecular weight acid, to provide useful lubricant additives.

47 Claims, No Drawings

NON-CONVENTIONAL OVERBASED MATERIALS

BACKGROUND OF THE INVENTION

The present invention relates to a new class of overbased materials and a process for preparing them.

Overbased materials are well known and have been described, for instance, in U.S. Pat. No. 3,492,231, McMillen, Jan. 27, 1970, which discloses a non-Newtonian colloidal disperse system comprising solid, metal-containing colloidal particles dispersed in a liquid dispersing medium and, as an essential third component, at least one organic compound which is soluble in said dispersing medium, the molecules of said organic compound being characterized by a hydrophobic portion and at least one polar substituent. Materials which can be overbased are generally oil-soluble organic acid including phosphorus acids, thiophosphorus acids, sulfur acids, carboxylic acids, thiocarboxylic acids, and the like.

U.S. Pat. No. 2,971,014, Mastin, Feb. 7, 1961, discloses an improved method of incorporating large amount of metal with hydroxy-aromatic compounds to form oil soluble compositions. The process comprises mixing (a) an alkylated monohydroxy aromatic compound; (b) an oil-soluble, metal-free non-tautomeric organic polar compound, and (c) at least two equivalents of a basic inorganic metal compound, then treating with an acidic gas.

U.S. Pat. No. 2,798,852, Wiese et al., Jul. 9, 1957, discloses oil-soluble metal-containing materials, prepared by heating a mixture of (a) a substantially neutral, aliphatic ketone having at least 13 carbon atoms; (b) a monohydric alcohol having a molecular weight less than 150, and (c) a basically reacting inorganic metal compound. The ketone can be an oxidized petroleum fraction. The presence of acidic products is said to be not essential to the successful operation of the method of preparation; it is preferred to use as a starting material an oxidized hydrocarbon which is substantially free from carboxylic acids and their esters. One form of the process includes the step of treating the immediate complex material with a weak: inorganic acidic material such as $CO_2$.

It has thus been known to prepare overbased materials using as a substrate an oil-soluble acidic material. The acid functionality can be provided by an acid group such as a carboxylic, sulfonic, or phosphonic acid, by aromatic—OH or amine groups, or by other groups exhibiting acidic labile hydrogen character, such as alpha-hydrogen-containing ketones. For some materials, the substrate is not itself acidic, but it is capable of being hydrolyzed under overbasing conditions to form an acidic material. For example, certain esters can be overbased because under overbasing conditions the ester will saponify to form the acid. Each of these acidic materials are normally viewed to exist as an anionic component of a salt, when they are employed as the substrate of an overbased material. The present invention, in contrast, provides overbased organic materials in which the substrate has no appreciable acidic character and thus cannot be neutralized in the usual sense by a base.

SUMMARY OF THE INVENTION

The present invention, therefore, provides a process for preparing an overbased organic composition, comprising reacting (a) a mixture comprising (i) an organic compound comprising at least one hydrocarbyl group containing in total at least 6 non-aromatic carbon atoms or at least 10 carbon atoms which comprise an aromatic structure, and a polar group containing at least one nitrogen, oxygen, or sulfur atom, said compound being substantially free from acidic hydrogen atoms or NH, OH, and SH groups and from functional groups which provide such organic compounds with acidic hydrogen atoms or NH, OH, or SH groups upon hydrolysis, (ii) a reaction medium comprising at least one organic solvent for the organic compound of (i), said reaction medium being a material which does not form a soluble salt of the metal base of (iii), (iii) a metal base in an amount in excess of one equivalent of base per mole of nitrogen, oxygen, and sulfur atoms in said organic compound (i); and (iv) a catalytic amount of an organic material capable of forming a salt with said metal base which is soluble in said reaction medium; with (b) a low molecular weight acidic material.

The present invention further provides a process for preparing an overbased organic composition, comprising reacting (a) a mixture comprising (i) an organic compound comprising; at least one hydrocarbyl group containing in total at least 6 non-aromatic carbon atoms or at least 10 carbon atoms which comprise an aromatic structure, and a polar group containing at least one nitrogen, oxygen, or sulfur atom, said ,compound being free from acidic hydrogen atoms and from functional groups which provide such organic compounds with acidic hydrogen atoms upon hydrolysis, (ii) a reaction medium comprising at least one organic solvent for the organic compound of (i), said reaction medium being a material which does not form a soluble salt of the metal base of (iii), (iii) a metal base in an amount in excess of one equivalent of base per mole of nitrogen, oxygen, and sulfur atoms in said organic compound (i); and (iv) an organic material capable of forming a salt with said metal base which is soluble in said reaction medium, present in an a catalytic amount of up to 6 percent by weight of the organic compound (i); with (b) a low molecular weight acidic material The present invention further provides a process for preparing an overbased organic composition, comprising reacting (a) a mixture comprising (i) an organic compound comprising at least one hydrocarbyl group containing in total at least 6 non-aromatic carbon atoms or at least 10 carbon atoms which comprise an aromatic structure, and a polar group containing at least one nitrogen, oxygen, or sulfur atom, said compound being free from acidic hydrogen atoms and from functional groups which provide such organic compounds with acidic hydrogen atoms upon hydrolysis, (ii) a reaction medium comprising at least one organic solvent for the organic compound of (i), said reaction medium being a material which does not form a soluble salt of the metal base of (iii), (iii) a metal base in an amount in excess of one equivalent of base per mole of nitrogen, oxygen, and sulfur atoms; in said organic compound (i); and (iv) a catalytic amount of an organic material capable of forming a salt with said metal base which is soluble in said reaction medium; with (b) a low molecular weight material comprising a phosphorus acid or anhydride.

The present invention likewise provides the overbased products of the foregoing processes.

DETAILED DESCRIPTION OF THE INVENTION

The first component of the compositions of the present invention is an organic compound comprising a hydrocarbyl chain of at least 6 non-aromatic carbon atoms or at least 10 carbon atoms which comprise an aromatic structure, and a polar group containing at least one nitrogen, oxygen, or sulfur atom. The compound is free from acidic hydrogen atoms and from functional groups which provide such organic compounds with such acidic hydrogen atoms upon hydrolysis. The expression "free from acidic hydrogen atoms" refers to materials which have a $pK_a$ (dissociation constant or acidity constant) of at least 10, preferably at least 10.25, and more preferably at least 10.5 or even 11.0 or higher. The $pK_a$ of acetic acid is 4.75, that of acetylacetone is 9.0, and that of phenol is 9.89; by contrast, that of ethyl mercaptan is 10.6, that of ethanol is about 16, that of acetone is about 20, and that of aniline is about 27.

Accordingly, carboxylic acids, sulfonic acids, phosphonic acids, phenols, and diketo compounds with acidic hydrogen atoms are excluded from consideration in the present invention. Also excluded are materials which yield such acidic compounds upon hydrolysis. For example, carboxylic esters are not generally considered to be acids. However, under hydrolysis conditions such as those encountered in a typical overbasing process, carboxylic esters hydrolyze to yield an acid and an alcohol. For this reason, esters are normally excluded from consideration in the present invention. Similarly, amides and other materials such as thiocarbonyl materials (R—C(=S)OR) which hydrolyze under overbasing conditions to form an acid are normally excluded.

An unexpected feature of the present invention is that non-acidic materials, as thus described, have been found to be useful in preparing overbased materials. These materials contain a polar group which contains at least one nitrogen, oxygen, or sulfur atom, preferably a nitrogen or sulfur atom. Suitable polar groups which contain sulfur atoms include mercaptan groups, sulfide groups, and thio groups.

Preferred sulfur-containing materials are thioethers, in particular materials which are substantially free from -SH groups. Particularly suitable sulfur-containing materials are sulfurized olefins. Sulfurized olefins are prepared by treating an olefin with a sulfur source, under reacting conditions. Suitable olefins preferably include terminal olefins and internal olefins, mono-olefins and polyolefins. Among the preferred olefins are alpha olefins (terminal olefins), which can be employed either as a single alpha olefin or as mixtures of alpha olefins. Alpha olefins include ethylene, propylene, and so on up to higher olefins; however, in order to provide adequate solubility the olefin should provide a carbon chain of at least 4 carbon atoms. Preferably the hydrocarbyl group of this component will contain 8 to 50 and more preferably 12 to 26 carbon atoms. Accordingly, suitable alpha olefins are the butenes, pentenes, hexenes, and preferably higher alpha olefins such as the octenes (including 2-ethylhex-1-ene), nonenes, decenes, undecenes, dodecenes, and similar higher alpha olefins containing e.g. 14, 16, 18, 20, 24, 26, or more carbon atoms. Most such alpha olefins are commercially available; in particular, mixtures of alpha olefins of certain chain lengths are readily available. For example, mixed $C_{16}$–$C_{18}$ olefins are available from Chevron under the trade name Gulftene™; this mixture is particularly suitable for preparation of sulfurized olefins for use in the present invention. The alpha olefins can be substituted with other functional groups if desired, provided, however, that such functional groups do not provide any significant amount of acidic hydrogen character to the compound, as discussed above. For example, hydroxyalkyl sulfides, such as the reaction product of 5-dodecyl mercaptan and propylene oxide, can be quite suitable.

The process for preparing sulfurized olefins is well-known and will not be described in detail here. In one embodiment, sulfurized olefins are produced by (1) reacting sulfur monochloride with a stoichiometric excess of an olefin, (2) treating the resulting product with an alkali metal sulfide in the presence of free sulfur in a mole ratio of no less than 2:1 in an alcohol-water solvent, and (3) reacting that product with an inorganic base. This procedure is described in greater detail in U.S. Pat. No. 3,471,404. The sulfurized olefins which are useful in the compositions of the present invention also may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions is described in U.S. Pat. No. 4,191,659.

In another embodiment the organic compound of (i) can be an amine. Amines include monoamines and polyamines. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines, and can be saturated or unsaturated. The amines can also contain non-hydrocarbon substituents or groups as long as these groups do not impart acidity to the molecule, as described above. Such non-hydrocarbon substituents or groups include lower alkoxy, lower alkyl mercapto, or interrupting groups such as —O— and —S— (e.g., as in such groups as $—CH_2CH_2—X—CH_2CH_2$ where X is —O— or —S—). For example, a useful amine is (N-$C_{16-18}$ alkyl propylenediamine, available commercially as Duomeen™O. In general, the amine may be characterized by the formula $R^7R^8R^9N$ where $R^7$, $R^8$, and $R^9$ are each independently hydrogen or hydrocarbon, amino-substituted hydrocarbon, hydroxy-substituted hydrocarbon, alkoxy-substituted hydrocarbon, or amino groups, provided that not all of $R^7$, $R^8$, and $R^9$ are hydrogen.

The amine should contain at least one carbon chain of at least 4 carbon atoms. Preferably the hydrocarbyl group of this component will contain 8 to 50 and more preferably 12 to 26 carbon atoms. Accordingly, suitable groups include alkyl groups such as butyl, pentyl, hexyl, and preferably higher alkyl groups such as octyl (including 2-ethylhexyl), nonyl, decyl, undecyl, dodecyl, and similar higher alkyl groups e.g. 14, 16, 18, 20, 24, 26, or more carbon atoms. Both straight chain and branched groups can be used. Most such amines are commercially available. For example, N-alkyl trimethylenediamine is available from Akzo under the names Duomeen T™ and Duomeen C™. The alkyl groups can be substituted with other functional groups if desired, provided, however, that such functional groups do not provide any significant amount of acidic hydrogen character to the compound, as discussed above.

Monamines include mono-aliphatic, di-aliphatic, and tri-aliphatic substituted amines wherein the aliphatic group can be saturated or unsaturated and straight or branched chain. Thus, they are primary, secondary, or tertiary aliphatic amines. Such amines include, for example, mono-, di- and tri-alkyl-substituted amines, mono-, di, and tri-alkenyl-substituted amines, and amines having one or more N-alkenyl substituent and N-alkyl substituent. Specific examples of such monoamines include n-butylamine, di-n-butylamine, tri-n-butylamine, allylamine, isobutylamine, cocoamine, stearylamine, laurylamine, methyllaurylamine, oleylamine, N-methyl-octylamine, dodecylamine, and octadecylamine.

Examples of cycloaliphatic-substituted aliphatic amines, aromatic-substituted aliphatic amines, and heterocyclic-substituted aliphatic amines, include 2-(cyclohexyl)ethylamine, benzylamine, phenethylamine, and 3-(furyl-propyl)amine.

Cycloaliphatic monoamines are those monamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include substituted anilines, di-(para-methylphenyl)amine, naphthylamine, and N,N-di(butyl)aniline. Examples of aliphatic-substituted, cycloaliphatic-substituted, and heterocyclic-substituted aromatic monoamines are para-ethyoxyaniline, para-dodecylaniline, cyclohexyl-substituted naphthylamine, and thienyl-substituted aniline.

Among the suitable nitrogen compounds are the polyamines. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

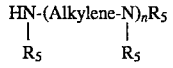

wherein n has an average value from 1, or 2 to 10, or to 7, or to 5, and the "Alkylene" group has from 1, or 2 to 10, or to 6, or to 4 carbon atoms. Each $R_5$ is independently hydrogen, or an aliphatic or hydroxy-substituted aliphatic group of up to 30 carbon atoms. In one embodiment, $R_5$ is defined the same as $R_1$.

Such alkylenepolyamines include methylenepolyamines, ethylenepolyamines, butylenepolyamines, propylenepolyamines, pentylenepolyamines, etc. The higher homologs and related heterocyclic amines such as piperazines and N-aminoalkyl-substituted piperazines are also included. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, pentaethylenehexamine, etc.

Higher homologs obtained by condensing two or more of the above-noted alkylene amines are similarly useful as are mixtures of two or more of the aforedescribed polyamines.

Ethylenepolyamines, such as those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylenepolyamines including cyclic condensation products such as the aforedescribed piperazines. Ethylenepolyamine mixtures are useful.

Other useful types of polyamine mixtures are those resulting from stripping of the above-described polyamine mixtures to leave as residue what is often termed "polyamine bottoms". In general, alkylenepolyamine bottoms can be characterized as having less than two, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentamine and 76.61% pentaethylenehexamine and higher (by weight). These alkylenepolyamine bottoms include cyclic condensation products such as piperazine and higher analogs of diethylenetriamine, triethylenetetramine and the like.

Among the amines, tertiary amines are sometimes preferred, i.e., those amines which are substantially free from —NH groups.

Also included within the scope of acceptable amines are amines which are present initially as amine, salts. Amine salts are salts of an amine (as a basic species) and an acidic species. They can be generally represented by the structure $R_1R_2R_3NH^+ A^-$, where $A^-$ is an anionic group. They can also include quaternary amine salts, $R_1R_2R_3R_4N^+ A$. For such materials the definition of acidity becomes more complicated, since the amine moiety might be construed to contain an acidic hydrogen (that derived from the acid). Alternatively, the anionic group might be construed to be in fact an acid group, to the extent that it might exist in its unneutralized form AH. Nevertheless, such amine salts are considered to fall within the broad definition of non-acidic materials, for the purposes of the present invention. In the first place, amine salts are not acids, but salts. Secondly, during the overbasing process a large amount of a strong base (e.g., NaOH) will be present. This strong base will tend to displace the weak amine base, leading to the original amine plus a salt of the acid, e.g., $R_1R_2R_3N+NaA+H_2O$. Hence in practice there will be no acid effectively present. Finally, and preferably, in most cases the anionic group of the amine salt will be a low molecular weight group and will have fewer than the requisite number of carbon atoms to contribute to the overbasing reaction; that is, it will contain no non-aromatic hydrocarbyl chains of at least 6, preferably at least 8, more preferably at least 12 carbon atoms, and it will contain no hydrocarbyl chains of at least 10 carbon atoms which comprise an aromatic structure.

Finally, the organic compound can be a material which contains an oxygen atom. Such materials include alcohols, ethers, and ketones, and include aliphatic, aromatic, cycloaliphatic, heteroaliphatic, and mixed materials, much as described above for the nitrogen (amine) component. The oxygen containing material can also be a polyether, such as polybutylene oxide, of various molecular weights. The total number of carbon atoms in the hydrocarbyl chain or chains associated with this species will likewise be at least 6 nonaromatic carbon atoms, preferably 8 to 50, and more preferably 12 to 26; if an aromatic ring is present in the hydrocarbyl group, there will be at least 10 carbon atoms.

Examples of suitable alcohols include n-hexanol, cyclohexanol, n-octanol, 2-ethyl hexanol, dodecanol, commercial mixtures of $C_{12}$ to $C_{26}$ alcohols, $C_{18}$ alcohols, mixtures of alcohols having greater than 15 carbon atoms (available from Shell), alkoxylated alcohols, including ethoxylated alcohols such as $C_{12-16}$-alkyl-$(C_2H_4O)_5H$ (Tergitol™26-L-5 from Union Carbide), and aromatic hydroxy compounds such as 4-phenylbutanol and alkyl-substituted benzyl alcohols.

Among the oxygen-containing materials, ethers are sometimes preferred, in particular, materials which contain substantially no —OH groups. Examples of suitable ethers include ethoxylated and propoxylated alcohols having terminal ethoxy groups, including materials from BASF, and Tergitol™, from Union Carbide. Also included are materials of the formula $R—(OC_2H_4)_nOH$, where R is an alkyl group of 16–18 ,carbon atoms and n is about 5. Also included are monoethers such as butyl ether and methyl hexyl ether.

Examples of suitable ketones include 2-hexanol, 3-hexanone, the methylpentanones, 2-octanone, and methyl-3-heptanone.

In a preferred embodiment the oxygen functionality is present as an additional functional group on a molecule having sulfur or nitrogen functionality, as described above. Examples of such materials include ethoxylated amines, under the trade name Ethomeen™, from Akzo, including ethoxylated cocoalkyl-amines ethoxylated tallowalkylamines, ethoxylated soyaalkylamines, and ethoxylated octadecylamines, where the total number of ethylene oxide units can be, e.g., 2, 5, 10, 15 or 50. Other examples include ethoxylated diamines, available under the trade names Ethomeen™ T/13, t/20, and T/25, also from Akzo, typically ethoxylated N-tallow-1,3,diaimopropanes, where the number of ethylene oxide units is, e.g., 3, 10, or 15. Yet other examples include hydroxy alkyl sulfides including those of structures $R—S—(C_2H_4)—OH$ and $R—S—CH_2CH(OH)C_2H_5$.

The amount of this organic compound in the final overbased composition including the reaction medium (described below), is typically 10 to 40 percent by weight, preferably 15 to 30 percent, and more preferably 20 to 30 percent.

The organic compound described above is, or becomes, through the present invention, a substrate of an overbased material. Conventional overbased materials are well known in the lubricating arts, and are generally single phase, homogeneous Newtonian systems characterized by a metal content in excess of that which would be present according to the stoichiometry of the metal and the particular acidic organic compound reacted with the metal. The overbased materials of the present invention differ from those of the prior art in that, in place of the acidic organic compound there is employed a non-acidic, non-reactive compound containing oxygen, sulfur, or nitrogen atom(s), as described in detail above.

The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. For the present invention, of course, this acidic material is not employed. However, a metal ratio can be defined, by analogy, to be the ratio of the total equivalents of the metal to the moles of nitrogen, oxygen, and sulfur atoms in the organic compound. The overbased materials of the present invention typically contain 2 to 30 equivalents of metal per mole of nitrogen, oxygen, or sulfur atoms in the organic compound, and preferably 5 to 25 equivalents.

The basicity of the overbased materials of the present invention generally is expressed in terms of a total base number. A total base number is the amount of acid (perchloric or hydrochloric) needed to neutralize all of the overbased material's basicity. The amount of acid is expressed as potassium hydroxide equivalents. Total base number is determined by titration of one gram of overbased material with 0.1 normal hydrochloric acid solution using bromophenol blue as an indicator. The overbased materials of the present invention generally have a total base number of at least 20, preferably 100, more preferably 200. The overbased material generally 5have a total base number up to 600, preferably 500, more preferably 400. The equivalents of overbased material is determined by the following equation: equivalent weight=(56,100/total base number). For instance, an overbased material with a total base number of 200 has an equivalent weight of 280.5 (eq. wt.=56100/200). The equivalents of phosphite are determined by dividing the molecular weight of the phosphite by the number of phosphorus atoms in the phosphite.

The overbased materials of the present invention are prepared by reacting an acidic material (typically an inorganic acid or lower carboxylic acid such as acetic acid; preferably carbon dioxide) with a mixture comprising an the non-acidic organic material described in detail above, a reaction medium, a stoichiometric excess of a metal base, and a promoter.

The metal compounds useful in making the basic metal salts (A) are generally any Group 1a, 1b, 2a, or 2b metal compounds (CAS version of the Periodic Table of the Elements). The Group 1 a metals of the metal compound include alkali metals (sodium, potassium, lithium, etc.). The Group 1 metals are preferably sodium, potassium, and lithium. The Group 2a metals of the metal base include the alkaline earth metals (such as barium and, preferably, magnesium and calcium); Group 2b metals include zinc and cadmium. Generally the metal compounds are delivered as metal salts. The anionic portion of the salt can be hydroxyl, oxide, carbonate, borate, nitrate, and other such anions.

An acidic material is used to accomplish the formation of the basic metal salt (A). The acidic material may be a liquid such as acetic, nitric, phosphoric, or sulfuric acid. Inorganic acidic materials in a solid or gaseous phase may also be used, such as HCl, $SO_2$, $SO_3$, $CO_2$, $H_2S$, or $P_2O_5$, preferably $CO_2$. Some of the preceding materials are not technically acids, but anhydrides which become acids in the presence of a protic material such as water. Preferred acidic materials include carbon dioxide, sulfur dioxide, sulfur trioxide, and phosphorus pentoxide. It is believed that preparation of overbased materials in which the acidic material is a low molecular weight inorganic phosphorus acid or anhydride has not been feasible using conventional substrates. Another preferable acidic material is a gas such as carbon dioxide. Typically about 1 equivalent of acidic material is employed per equivalent of the metal base. Mixtures of acidic materials can also be used.

A promoter is a chemical employed to facilitate the incorporation of metal into the basic metal compositions. The promoters are quite diverse and are well known in the art, as evidenced by the cited patents. A particularly comprehensive discussion of suitable promoters is found in U.S. Pat. Nos. 2,777,874, 2,695,910, and 2,616,904. These include the alcoholic and phenolic promoters, which are preferred. The alcoholic promoters include the alkanols of one to twelve carbon atoms such as methanol, ethanol, amyl alcohol, octanol, isopropanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

The reaction medium in which the above overbasing reaction is conducted comprises at least one inert, organic solvent (mineral oil, naphtha, toluene, xylene, etc.) for the non-acidic organic compound. Preferably the medium is an oil such a mineral oil; alternatively it can be a volatile organic solvent. The use of a volatile organic solvent can be desirable when it is intended to strip off the solvent to replace it with an alternative solvent or even to isolate the remaining solids. The amount of the reaction medium should be an amount suitable to provide ready solution or dispersion of the other components during the process of preparing the overbased material. Typically the reaction medium will comprise 15 to 60 percent by weight of the total composition, preferably 25 to 50 percent, and more preferably 30 to 40 percent.

The reaction medium, however, should be a material which does not form a soluble salt of the metal base described above. Thus certain alcohols would be excluded from use as the reaction medium. The function of providing a measure of solubility to the metal base, so that it can participate in the overbasing reaction, is accomplished, rather, by the use of a catalytic amount of an organic material which is capable of forming a salt with the metal base. The salt formed thereby should be soluble in the reaction medium. This organic material can be an acidic material such as a carboxylic acid, sulfonic acid, phosphorous acid, or, preferably, an alkylphenol. The amount of this organic material (the acidic material, for example) is described as a "catalytic amount," by which is meant a relatively small amount sufficient to permit incorporation of the metal into the corn position in association with the non-acidic organic material. The amount will not be so large that the acidic material itself begins to serve as the primary or a significant substrate for the overbasing process. These suitable amounts are typically 0.01 to 5 percent by weight of the total composition, and preferably 0.5 to 2 percent. Expressed in another fashion, the amount of the acidic organic material is typically 0.05 to 25 percent by weight of the non-acidic organic compound containing the oxygen, nitrogen, or sulfur, which is being overbased. Preferably the amount of the acidic organic material up to 15 percent by weight, preferably up to 9 percent, and more preferably up to 6 percent, e.g., 2–6 percent by weight of the non-acidic organic compound.

Patents specifically describing techniques for making basic salts of acids include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Reference may be made to these patents for their disclosures in this regard as well as for their disclosure of specific suitable basic metal salts. The teachings, of course, must be modified as appropriate for the use of the non-acidic organic compounds of the present invention in place of the acids described in the references.

Briefly, the basic salts of the non-acidic organic materials of the present invention are prepared by preparing a mixture of the non-acidic organic compound, the reaction medium, the metal base, and the salt-forming organic material, and adding thereto the appropriate amount of the low molecular weight acidic material, that is, one preferably containing no more than 6 carbon atoms. Liquid or solid acidic materials can be added to a stirred mixture by conventional means; gaseous acidic materials can be added by passing the gas (bubbling the gas) into a stirred reaction mixture. The temperature of the addition of gas is not critical; temperatures in the range of 100° to 150° C. have been found to be quite suitable. The reaction can be done in a single step or incrementally.

Once an overbased material is obtained it can be further treated or reacted, as desired. Carbonate overbased materials (i.e., those prepared by reaction with carbon dioxide) can be reacted with a source of sulfur dioxide to provide a sulfite overbased material. During the course of the reaction, some or all of the carbon dioxide will be displaced by the sulfur dioxide. In another modification, sulfite overbased material (prepared either by direct addition of $SO_2$ or by $SO_2$ displacement of $CO_2$) can be further reacted with a source of sulfur to provide a thiosulfate overbased material. Suitable sources of sulfur include elemental sulfur, sulfur halides, combinations of sulfur or sulfur oxides with hydrogen sulfide, phosphorus sulfides, and various sulfurized organic compounds. Sulfur halides include sulfur monochloride and sulfur dichloride. Phosphorus sulfides include $P_2S_5$, $P_4S_7$, $P_4S_3$, and $P_2S_3$. Sulfurized organic compounds include 2,2'-dithiodiisobutyraldehyde, dibenzyl sulfide, dixylyl sulfide, dicetyl sulfide, diparaffin wax sulfide and polysulfide, and cracked wax oleum sulfides sulfurized oils, and sulfurized fatty acids. Additional sulfur sources, and methods of their preparation, can be found by referring to European Publication 0 586 258. The conversion of carbonate overbased salts of conventional acid substrates into sulfite overbased materials has been disclosed in detail in U.S. Pat. No. 5,250,204. Further details on the conversion of sulfite overbased salts of conventional acid substrates into thiosulfate overbased materials can be obtained by referring to European Publication 0 586 258.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The term "hydrocarbyl" is also intended to include hydrocarbylene, that is, groups having non-hydrocarbon functionality at multiple ends.

The materials of the present invention are useful as additives for lubricants in which they can function as conventional overbased detergents; they can also function as antiwear, antiweld, antioxidation, antifriction, antirust, anticorrosion, and/or extreme pressure agents. They may be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic or manual transmission fluids, transaxle lubricants, gear lubricants, including open and enclosed gear lubricants, tractor lubricants, metal-working lubricants, hydraulic fluids and other lubricating oil and grease compositions can also benefit from the incorporation therein of the compositions of the present invention. They may also be used as wirerope, walking cam, way, rock drill, chain and conveyor belt, worm gear, bearing, metalworking, and rail and flange lubricants, and as lubricants in industrial fluids in general, whether oil or water base.

As described above, the formulated lubricating composition contains an oil of lubricating viscosity. The oils of lubricating viscosity include natural or synthetic lubricating oils and mixtures thereof. Natural oils include animal oils, mineral lubricating oils, and solvent or acid treated mineral oils. Synthetic lubricating oils include hydrocarbon oils (polyalpha-olefins), halo-substituted hydrocarbon oils, alkylene oxide polymers, esters of dicarboxylic acids and polyols, esters of phosphorus-containing acids, polymeric tetrahydrofurans and silicon-based oils. Preferably, the oil of lubricating viscosity is a hydrotreated mineral oil or a synthetic lubricating oil, such as a polyolefin. Examples of useful oils of lubricating viscosity include XHVI basestocks, such as 100N isomerized wax basestock (0.01% sulfur/141 VI), 120N isomerized wax basestock (0.01% sulfur/ 149 VI), 170N isomerized wax basestock (0.01% sulfur/142 VI), and 250N isomerized wax basestock (0.01% sulfur/146 VI); refined basestocks, such as 250N solvent refined paraffinic mineral oil (0.16% sulfur/89 VI), 200N solvent refined naphthenic mineral oil (0.2% sulfur/60 VI), 100N solvent refined/hydrotreated paraffinic mineral oil (0.01% sulfur/98 VI), 240N solvent refined/hydrotreated paraffinic mineral oil (0.01% sulfur/98 VI), 80N solvent refined/hydrotreated paraffinic mineral oil (0.08% sulfur/127 VI), and 150N solvent refined/hydrotreated paraffinic mineral oil (0.17% sulfur/127 VI). A description of oils of lubricating viscosity occurs in U.S. Pat. No. 4,582,618 (column 2, line 37 through column 3, line 63, inclusive).

In one embodiment, the oil of lubricating viscosity is a polyalpha-olefin (PAO). Typically, the polyalpha-olefins are derived from monomers having from 4 to 30, or from 4 to 20, or from 6 to 16 carbon atoms. Examples of useful PAOs include those derived from decene. These PAOs may have a viscosity from 3 to 150, or from 4 to 100, or from 4 to 8 cSt at 100° C. Examples of PAOs include 4 cSt polyolefins, 6 cSt polyolefins, 40 cSt polyolefins and 100 cSt polyalphaolefins.

In one embodiment, the lubricating composition contains an oil of lubricating viscosity which has an iodine value of less than 9. Iodine value is determined according to ASTM D-460. In one embodiment, the oil of lubricating viscosity has a iodine value less than about 8, or less than 6, or less than 4.

In one embodiment, the oil of lubricating viscosity are selected to provide lubricating compositions with a kinematic viscosity of at least 3.5 cSt, or at least 4.0 cSt at 100° C. In one embodiment, the lubricating compositions have an SAE gear viscosity grade of at least SAE 75W. The lubricating composition may also have a so-called multigrade rating such as SAE 75W-80, 75W-90, 75W-140, 80W-90, 80W-140, g5W-90, or 85W-140. Multigrade lubricants may include a viscosity improver which is formulated with the oil of lubricating viscosity to provide the above lubricant grades. Useful viscosity improvers include but are not limited to polyolefins, such as ethylene-propylene copolymers, or polybutylene rubbers, including hydrogenated rubbers, such as styrene-butadiene or styrene-isoprene rubbers; or polyacrylates, including polymethacrylates. In one embodiment, the viscosity improver is a polyolefin or polymethacrylate. Viscosity improvers available commercially include Acryloid™ viscosity improvers available from Rohm & Haas; Shellvis™ rubbers available from Shell Chemical; Trilene™ polymers, such as Trilene™ CP-40, available commercially from Uniroyal Chemical Co., and Lubrizol 3100 series and 8400 series polymers, such as Lubrizol®3174 available from The Lubrizol Corporation.

In one embodiment, the oil of lubricating viscosity includes at least one ester of a dicarboxylic acid. Typically the esters containing from 4 to 30, preferably from 6 to 24, or from 7 to 18 carbon atoms in each ester group. Here, as well as elsewhere, in the specification and claims, the range and ratio limits may be combined. Examples of dicarboxylic acids include glutaric, adipic, pimelic, suberic, azelaic and sebacic. Example of ester groups include hexyl, octyl, decyl, and dodecyl ester groups. The ester groups include linear as well as branched ester groups such as iso arrangements of the ester group. A particularly useful ester of a dicarboxylic acid is diisodecyl azelate.

EXAMPLES

Example 1

Into a 2 L flask is added 350 g (1.0 equivalents) N-tallow-1,3-diaminopropane ($RNHC_3H_6NH_2$), 18 g (1.0 equivalents) water, and 200 g mineral oil. Into the stirred mixture is blown sulfur dioxide at 28 L/hr (1.0 std. $ft^3$/hr) at room temperature for 1.5 hours, giving a white viscous material. The reaction is exothermic and the reaction temperature increases to 60°–80° C. The reaction mixture is brought to 120°–130° C. under nitrogen, 14 L/hr (0.5 std. $ft^3$/hr). After stirring for an additional 0.5 hour, the hot yellow fluid is filtered over a filter aid to afford 485 g of viscous light yellow oil.

Example 2

Into a 3 L flask is added 485 g (0.76 equivalents) of the product of Example 1, 100 g of polyisobutyl (m.w. 1000) succinic anhydride, 100 g dodecyl phenol, and 400 g mineral oil. The mixture is stirred and 200 g sodium hydroxide is added at about 80° C.; $CO_2$ is blown into the mixture at 28 L/hr (1.0 std. $ft^3$/hr) at 120° C. After 2 hours, 35 mL water is removed by distillation. To this mixture is added an additional 200 g sodium hydroxide while allowing the mixture to cool. Additional carbon dioxide is blown into the mixture at 28 L/hr (1.0 std. $ft^3$/hr) at 130° C. After stirring for 3 hours, and additional 45 mL water is removed by distillation. An additional portion of 200 g sodium hydroxide is added, when the mixture had cooled, followed by blowing with carbon dioxide, 28 L/hr (1.0 std. $ft^3$/hr) at 130°

C. An additional 40 mL water is removed by distillation after 1.5 hours. The mixture is cooled and a final charge of 200 h sodium hydroxide is added, and carbon dioxide is blown into the mixture as before, but at 140° C. for 3 hours, during which time 47 g water is removed by distillation. Thereafter the batch is stripped in vacuo at 130° C. at 2.7 kPa (20 mm Hg). The resulting material contains 4.6% unreacted inorganic solids. The reaction mixture is filtered through a filter aid to give 1791 g of a light brown oil product.

Example 3

Into a 2 L flask is charged 1060 g (10 equivalents) of the product of Example 2. The composition is blown with gaseous $SO_2$ at 35 L/hr (1.25 std. $ft^3$/hr) at 130° C. for 1–2 hours. After further stirring for 7–8 hours most of the product of Example 2 is converted, as determined by infrared analysis. The reaction mixture is purged with nitrogen 28 L/hr (1.0 std. $ft^3$/hr) at 130° C. for 1–2 hours and then filtered over filter aid to provide 1050 g of light brown oil, which represents the sulfite product.

Example 4

To a 2 L flask is charged 940 g of the product of Example 3, 114 g sulfur, and 200 g mineral oil. The mixture is stirred at 130° C. for 0.5 hour, giving a black oil, the thiosulfate detergent, as the product. To this mixture is added 80 g sodium hydroxide and $CO_2$ is blown at 28 L/hr (1.0 std. $ft^3$/hr) at 130° C. for 3 hours. During this time 10 mL water is recovered by distillation. The mixture is stripped at 130° at 2.7 kPa (20 mm Hg); no additional water is recovered. The resulting black oil, 1350 g, is filtered through filter aid to provide 1200 g dark brown oil product.

Example 5

To a 2 L flask is charged 130 g (0.5 equivalents) of sulfurized $C_{16-18}$ α olefin, .20 g (0.03 equivalents) alkyl succinic anhydride (the alkyl group having a number average molecular weight of about 1000), 20 g (0.07 equivalents) p-dodecyl phenol, and 100 g mineral oil. To the mixture is added 40 g sodium hydroxide at 50° C. with stirring. The mixture is heated to 140° C. and blown with carbon dioxide at 21 L/hr (0.75 std. $ft^3$/hr) for 1.5 hours. Infrared analysis of the mixture indicates the formation of carbonate. The mixture is cooled, and 40 g sodium hydroxide is added and the mixture treated with additional carbon dioxide as above. After stirring the mixture for 3 hours, a third charge of sodium hydroxide (40 g) is added and the mixture carbonated under the same conditions. During the carbonation process, 20 g of water is removed and collected by distillation.

The mixture is vacuum stripped at 150° C. and the resulting liquid filtered through filter aid to provide 371 g light brown oil product.

Example 6

To a 1 L flask is added 350 g (2.3 equivalents) of the oil product from Example 5. The mixture is blown with sulfur dioxide at 28 L/hr (1.0 std. $ft^3$/hr) at 100° C. for 2 hours until no sodium carbonate is found by infrared examination at 880 $cm^{-1}$. The mixture is purged with nitrogen at 28 L/hr (1.0 std. $ft^3$/hr) at 100° C. for 0.5 hours. The mixture is filtered through filter aid to provide 305 g light brown oil product.

Example 7

To a 1 L flask is added 290 g (1.2 equivalents) of the oil product from Example 6 and 25 g (0.78 equivalents) sulfur. The mixture is stirred at 120xO under a nitrogen flow of 14 L/hr (0.5 std. $ft^3$/hr) for 2 hours until a clear mixture is obtained. Infrared analysis shows the formation of thiosulfate. Filtration through filter aid provides 290 g oil product.

Example 8

To a 2 L flask is added 1250 g of a material substantially similar to that prepared from Example 6. The mixture is stirred and 131 g of sulfur are added, stirring the mixture at 135° C. for 7 hours. To this mixture is added an additional 40 g sodium hydroxide, and $CO_2$ is bubbled into the stirred mixture at 42 L/hr (1.5 std. $ft^3$/hr) for 3 hours at 135° C. The mixture is stripped under vacuum at 150° C. and the resulting mixture filtered through filter aid, yielding 1075 g dark brown oil product.

Example 9

To a 2 L flask is added 520 g sulfurized $C_{16-18}$ α-olefin oil (containing 12.3% by weight sulfur), 50 g mineral oil, 30 g propylene tetramer-substituted phenol, and 30 g polyisobutylene-substituted succinic anhydride dispersant. To this mixture is added, with stirring, 80 g sodium hydroxide, and $SO_2$ is blown into this mixture at 14 L/hr (1.0 std. ft3/hr) at 120°–130° C. for 2.5 hours. After cooling, another charge of 80 g sodium hydroxide is added, with stirring, and $SO_2$ is again blown into the mixture for 3.5 hours at 120°–130° C. A total of 30 mL water is collected during the process. The resulting mixture is stripped in vacuo. Filtration is difficult, so the mixture is diluted with toluene, the solids removed by centrifugation, and the toluene diluent removed by vacuum distillation. The resulting 550 g oil is the product.

Example 10

To a 2 L flask is charged 350 g N-oleyl-1,3-diaminopropane, 98 g ammonium molybdate [$(NH_4)_2MoO_4$], and 150 g toluene. To this mixture is added 20 mL water, and the mixture is heated to 100°–100° C. and refluxed for 2 hours, during which time 25 mL water is collected by distillation. An additional 100 g of tallowdiaminopropane is added to the batch and stirring continued for 0.5 hour. The mixture is vacuum stripped and the remaining brown oil filtered through filter aid, to yield 475 g brown oil.

Example 11

To a 2 L flask is charged 210 g of the product from Example 10, 75 g mineral oil, 20 g polyisobutylene-substituted succinic anhydride dispersant, 20 g propylene tetramer-substituted phenol, and 80 g sodium hydroxide. The mixture is bubbled with carbon dioxide at 140° C., 28 L/hr (1.0 std. $ft^3$/hr), for 2 hours. No water is collected by distillation. The mixture is allowed to cool, and an additional charge of 60 g sodium hydroxide is added and carbonation is resumed at 140° C., 42 L/hr (1.5 std. $ft^3$/hr) for 2 hours. The mixture is again allowed to cool, a third charge of 40 g sodium hydroxide is added, and carbonation is resumed as above. After 2 hours, the mixture is vacuum stripped, then filtered through filter aid to yield 420 g of an oil which became gel-like upon cooling.

Example 12

To a 2 L flask is charged 190 g Propomeen™ T/12 from Akzo ($C_{12}$ alkyl-N($CH_2CH(CH_3)OH)_2$), 200 g mineral oil, and 20 g sodium hydroxide. The mixture is stirred and is blown with sulfur dioxide gas at 28 L/hr (1.0 std. $ft^3$/hr) at room temperature, the exothermic nature of the reaction causing the temperature to, increase to 80°–120° C. After ½ hour, 15 g of propylene tetramer-substituted phenol and 25 g of polyisobutylene (940 m.w.) substituted maleic anhydride (containing 15% mineral oil) are added. To the resulting clear material is added 60 g sodium hydroxide, and the mixture is blown with carbon dioxide, at 42 L/hr (1.5 std. $ft^3$/hr) at 150° C. for 1 hour. Fifteen mL water is recovered by distillation; then an additional charge of 100 g sodium hydroxide is added, and carbonation is repeated, as above at 150° C. Additional water is recovered, and an additional 100 g sodium hydroxide is added. After 2.5 hours of additional carbonation there is received a total of 50 g water. The resulting mixture is stripped in vacuo and filtered to obtain the product.

Example 13

To a 2 L flask is charged 175 g tallowdiaminopropane, 150 g mineral oil, 30 g polyisobutylene-substituted succinic anhydride dispersant and 27 g propylene tetramer-substituted phenol. The mixture is heated to 50°–60° C. and 42 g lithium hydroxide monohydrate is added, with stirring. Carbon dioxide is blown into the mixture at 28 L/hr (1.0 std. $ft^3$/hr) for 2 hours at 120°–130° C. (the exothermic reaction increases the temperature to 170°–180° C.). Infrared analysis shows the formation of $Li_2CO_3$. A second charge of 42 g lithium hydroxide monohydrate is added and the mixture carbonated as above, followed by addition of a third charge of 42 g lithium hydroxide and carbonation. To the resulting viscous oil is added hexane diluent, the mixture centrifuged and filtered through filter aid, then vacuum stripped to yield 350 g light brown oil.

Example 14

To a 2 L flask is added 133 g of a hydroxy thioether (adduct of t-dodecylmecaptan and propylene oxide, $C_{12}H_{26}SCH_2CHOHCH_3$), 100 g mineral oil, 10 g of propylene tetramer-substituted phenol, 20 g of polyisobutylene-substituted succinic anhydride dispersant and 40 g sodium hydroxide. This mixture is heated to 140° C. with stirring and is blown with carbon dioxide at 28L/hr (1.0 std. $ft^3$/hr) for 1 hour, during which time 5 mL water is recovered by distillation. The mixture is cooled and another charge of sodium hydroxide, 40 g, is added and carbonation is continued as above, for 3 hours. The mixture is again cooled and a third charge of 40 g sodium hydroxide is added and carbonation resumed for an additional 2 hours. To the mixture is added 100 mL toluene diluent, followed by vacuum stripping. The residual material is filtered through a filter aid to provide 355 g oil product.

Example 15

To a 1 L flask is charged 175 g tallowdiaminopropane, 150 g mineral oil, 20 g of calcium salt of methylene-coupled heptyl phenol, 20 g polyisobutylene-substituted succinic anhydride dispersant, 50 g mixed isobutyl and amyl alcohols (1:1), and 12 g methanol. In this mixture is dissolved, with stirring, 2 g calcium chloride and 8 g water; to this mixture is added, with stirring, 37 g calcium hydroxide,. The mixture is heated to 50° C. and carbon dioxide is blown into the reaction mixture at 28 L/hr (1.0 std. $ft^3$/hr) for 2 hours, maintaining the temperature at about 50°–60° C. After 2 hours, infrared analysis indicates formation of calcium carbonate. An additional 18 g of calcium hydroxide is added and carbonation is continued for an additional 2.5 hours. The mixture is then purged with nitrogen at 150° C. and the solvent is removed by distillation followed by vacuum stripping for 0.5 hours. The mixture is filtered using a filter aid, to yield 360 g of a green oil product.

Example 16

To a 1 L flask is charged 175 g tallowdiaminopropane, 100 g mineral oil, 25 g polyisobutylene-substituted succinic anhydride dispersant, and 20 g propylene tetramer-substituted phenol. To this mixture is added, with stirring, 20 g sodium hydroxide at 50° C., followed by the addition of three portions of phosphorus pentoxide over a time period of 1.5 hours. The reaction, being exothermic, heats spontaneously to about 80° C. Stirring is continued for about 1 hour, followed by cooling to room temperature. An additional charge of 40 g sodium hydroxide is added at 50° C., followed by two portions of 17.5 g each phosphorus pentoxide, over a course of about 0.5 hour. After an additional hour of stirring, and additional charge of 17.5 g phosphorus pentoxide is added, at a temperature of about 90° C., then, after an additional 0.5 hours, a final charge of 17.5 g phosphorus pentoxide is added. Stirring is continued for 3 hours. Product is isolated as previously described.

Example 17

To a 1 L flask is charged 350 g of a dispersant prepared by reacting polyisobutyl succinic anhydride with poly(ethyleneamine) and 25 g propylene tetramer-substituted phenol. To this mixture, at 80° Cc, is added 20 g sodium hydroxide and 18 g phosphorus pentoxide. Stirring is continued for about 1.5 hours at 140°–150° C. The reaction mixture is cooled and an additional 40 g sodium hydroxide is added at 80° C., followed by 15 g phosphorus pentoxide. The temperature rises to 120° C. and the mixture is thereafter stirred at 150° C. for 2 hours. After cooling, an additional charge of 20 g phosphorus pentoxide is added and a 100 g mineral oil is added. The mixture is stirred at 150°–170° C. for 5 hours. Product is isolated as previously described.

Example 18

In a 250 mL flask is placed 35.3 g trioctylamine, 50 g mineral oil, 5 g polyisobutylene-substituted succinic anhydride dispersant, and 3 g propylene tetramer-substituted phenol. The mixture is heated to 50° C. and 8 g sodium hydroxide is added. The mixture is blown with carbon dioxide at 28 L/hr (1.0 std. $ft^3$/hr) at 140° C. for 0.5 hour. Infrared analysis indicates the presence of sodium carbonate. The mixture is cooled and an additional charge of 20 g sodium hydroxide is added and the mixture carbonated for an additional 1 hour. The resulting mixture is vacuum stripped. After cooling, 1 g magnesium sulfate is added, the mixture is stirred for 10 minutes, and then filtered at 120° C., yielding 110 g of a cloudy oil product.

Example 19

A 1 L flask is charged with 420 g Tergitol™26L-5 ($C_{12-16}$ linear alkyl —O—($C_2H_4O)_5$—H) and 40 g sodium hydroxide, then sparged with nitrogen at 24 L/hr (0.85 std. $ft^3$/hr).

The mixture is heated to 175°–180° C. and 4.5 mL of water is removed over 3.5 hours. The mixture is cooled and about 10 mL xylene and an additional 200 g sodium hydroxide are added. The mixture is heated to 144° C. and carbon dioxide is bubbled at 28 L/hr (1.0 std. $ft^3$/hr), the temperature rising to 150° C. The temperature of the mixture is increased to 160°–180° C. and 40 mL water is removed by distillation. The flow of carbon dioxide is decreased to about 3 L/hr (0.1 std. $ft^3$/hr) for 1 hour. Carbonation is discontinued and toluene diluent is added to the flask. The product is isolated by centrifugation and vacuum stripping of the supernatant liquid.

Example 20

A 0.5 L flask is charged with 59 g of the di-dodecyl ether of ethylene glycol pentamer, prepared by the reaction of Tergitol™28L-5 with bromododecane and sodium, 2.7 g propylene tetramer-substituted phenol, 6.5 g polyisobutylene-substituted succinic anhydride dispersant, and 50 g mineral oil. The mixture is heated to 50° C. , 20 g sodium hydroxide is added with stirring, and the mixture is brought to 150° C. Into this mixture is blown carbon dioxide at 14 L/hr (0.5 std. $ft^3$/hr) for 4 hours. Infrared monitoring indicates formation of sodium carbonate. The mixture is diluted with 59 g toluene and refluxed with a Dean-Stark trap to receive 3 mL water. Upon cooling, 5 g magnesium sulfate is added and the mixture is filtered under vacuum. The filtrate is stripped under vacuum, yielding 110 g light yellow oil as product.

Example 21

A 1 L flask is charged with 87 g N-oleyl-1,3-diaminopropane, 2.7 g propylene tetramer-substituted phenol, 6.5 g polyisobutylene substituted succinic anhydride dispersant, and 100 g mineral oil. The mixture is heated to 50° C., 20 g of sodium hydroxide is added, and the mixture is brought to 150° C. Into this mixture is blown carbon dioxide at 28 L/hr (1.0 std. $ft^3$/hr) for 4 hours. The mixture is filtered through filter aid at 100°–120° C., yielding 250 g light color oil product.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

I claim:

1. A process for preparing an overbased organic composition, comprising reacting (a) a mixture comprising (i) an organic compound comprising at least one hydrocarbyl group containing in total at least 6 non-aromatic carbon atoms or at least 10 carbon atoms which comprise an aromatic structure, and a polar group containing at least one nitrogen, oxygen, or sulfur atom, said compound being substantially free from acidic hydrogen atoms or NH, OH, and SH groups and from functional groups which provide such organic compounds with acidic hydrogen atoms or NH, OH, or SH groups upon hydrolysis, (ii) a reaction medium comprising at least one organic solvent for the organic compound of (i), said reaction medium being a material which does not form a soluble salt of the metal base of (iii), (iii) a metal base in an amount in excess of one equivalent of base per mole of nitrogen, oxygen, and sulfur atoms in said organic compound (i); and (iv) a catalytic amount of an organic material capable of forming a salt with said metal base which is soluble in said reaction medium;

with (b) a low molecular weight acidic material.

2. The overbased composition of claim 1 wherein the organic compound of (i) is an ether, thioether, or tertiary amine.

3. The process of claim 1 wherein the organic compound is a sulfurized olefin.

4. The process of claim 1 wherein the organic compound is a tertiary amine.

5. The process of claim 1 wherein the organic compound is an ether.

6. The process of claim 1 wherein the reaction medium is an oil.

7. The process of claim 1 wherein the metal base is an oxide or hydroxide of sodium, potassium, or lithium.

8. The process of claim 1 wherein the amount of metal base is about 2 to about 30 equivalents per mole of nitrogen, oxygen, and sulfur atoms in the organic compound of (i).

9. The process of claim 1, wherein the organic material of (iv) is an alkylphenol.

10. The process of claim 1 wherein the amount of the organic material of (iv) is about 0.05 to about 25% by weight of the organic compound of (i).

11. The process of claim 1 wherein the low molecular weight acidic material is carbon dioxide, sulfur dioxide, sulfur trioxide, or a phosphorus acid or anhydride.

12. The process of claim 1 wherein the low molecular weight acidic material is a gas, which is reacted with the mixture by passing the gas through the mixture at about 100° to about 150° C.

13. A process for preparing an overbased organic composition, comprising reacting (a) a mixture comprising (i) an organic; compound comprising at least one hydrocarbyl group containing in total at least 6 non-aromatic carbon atoms or at least 10 carbon atoms which comprise an aromatic structure, and a polar group containing at least one nitrogen, oxygen, or sulfur atom, said compound being free from acidic hydrogen atoms and from functional groups which provide such organic compounds with acidic hydrogen atoms upon hydrolysis, (ii) a reaction medium comprising at least one organic solvent for the organic compound of (i), said reaction medium being a material which does not form a soluble salt of the metal base of (iii), (iii) a metal base in an amount in excess of one equivalent of base per mole of nitrogen, oxygen, and sulfur atoms in said organic compound (i); and (iv) an organic material capable of forming a salt with said metal base which is soluble in said reaction medium, present in an a catalytic amount of up to 6 percent by weight of the organic compound (i);

with (b) a low molecular weight acidic material.

14. The process of claim 13 wherein the organic compound of (i) contains a nitrogen or sulfur atom.

15. The process of claim 13 wherein the organic compound of (i) is a sulfurized olefin.

16. The process of claim 13 wherein the alkylamine is a trialkylamine.

17. The process of claim 13 wherein the organic compound of (i) is an alkylamine which is added as an alkylamine salt.

18. The process of claim 13 wherein the reaction medium is an oil.

19. The process of claim 13 wherein the metal base is an oxide or hydroxide of sodium, potassium, or lithium.

20. The process of claim 13 wherein the amount of metal base is about 2 to about 30 equivalents per mole of nitrogen, oxygen, and sulfur atoms in the organic compound of (i).

21. The process of claim 13 wherein the organic material of (iv) is an alkylphenol.

22. The process of claim 13 wherein the low molecular weight acidic material is carbon dioxide, sulfur dioxide, sulfur trioxide, or a phosphorus acid or anhydride.

23. The process of claim 13 wherein the low molecular weight acidic material is a gas, which is reacted with the mixture by passing the gas through the mixture at about 100° to about 150° C.

24. The process of claim 13, wherein the metal base of (iii) is a basic sodium, potassium, lithium, magnesium, calcium, zinc, or cadmium compound;

further comprising including in the mixture (v) an additional portion of organic material capable of forming a salt with said metal base which is soluble in said reaction medium, such that the amounts of components (iv) and (v) are together 6 to 9 percent by weight of the organic compound (i).

25. The process of claim 24 wherein the organic material of (iv) and (v) is an alkylphenol.

26. A process for preparing an overbased organic composition, comprising reacting (a) a mixture comprising (i) an organic compound comprising at least one hydrocarbyl group containing in total at least 6 non-aromatic carbon atoms or at least 10 carbon atoms which comprise an aromatic structure, and a polar group containing at least one nitrogen, oxygen, or sulfur atom, said compound being free from acidic hydrogen atoms and from functional groups which provide such organic compounds with acidic hydrogen atoms upon hydrolysis, (ii) a reaction medium comprising at least one organic solvent for the organic compound of (i), said reaction medium being a material which does not form a soluble salt of the metal base of (iii), (iii) a metal base in an amount in excess of one equivalent of base per mole of nitrogen, oxygen, and sulfur atoms in said organic compound (i); and (iv) a catalytic amount of an organic material capable of forming a salt with said metal base which is soluble in said reaction medium;

with (b) a low molecular weight inorganic material comprising a phosphorus acid or anhydride.

27. The process of claim 26 wherein the phosphorus acid or anhydride is phosphorus pentoxide.

28. The process of claim 26 wherein the organic compound of (i) contains a nitrogen or sulfur atom.

29. The process of claim 26 wherein the organic compound of (i) is a sulfurized olefin.

30. The process of claim 26 wherein the alkylamine is a trialkylamine.

31. The process of claim 26 wherein the reaction medium is an oil.

32. The process of claim 26 wherein the metal base is an oxide or hydroxide of sodium, potassium, or lithium.

33. The process of claim 26 wherein the amount of metal base is about 2 to about 30 equivalents per mole of nitrogen, oxygen, and sulfur atoms in the organic compound of (i).

34. The process of claim 26 wherein the organic material of (iv) is an alkylphenol.

35. The process of claim 26 wherein the amount of the organic material of (iv) is about 0.05 to about 25% by weight of the organic compound of (i).

36. The product of the process of claim 1.

37. The product of the process of claim 13.

38. The product of the process of claim 24.

39. The product of the process of claim 26.

40. A lubricating composition comprising the overbased organic composition of claim 37 and an oil of lubricating viscosity.

41. A lubricating composition comprising the overbased organic composition of claim 38 and an oil of lubricating viscosity.

42. A lubricating composition comprising the overbased organic composition of claim 36 and an oil of lubricating viscosity.

43. A lubricating composition comprising the overbased organic composition of claim 39 and an oil of lubricating viscosity.

44. A composition comprising:

(a) an organic compound comprising at least one hydrocarbyl group containing in total at least 6 non-aromatic carbon atoms or at least 10 carbon atoms which comprise an aromatic structure, and a polar group containing at least one nitrogen, oxygen, or sulfur atom, said compound being substantially free from acidic hydrogen atoms or NH, OH, and SH groups and from functional groups which provide such organic compounds with acidic hydrogen atoms or NH, OH, or SH groups upon hydrolysis, (b) a finely divided metal salt of a low molecular weight acidic material or a sulfurized derivative thereof, present in stoichiometric excess of the number of nitrogen, oxygen, and sulfur atoms in said organic compound (a), (c) an inert organic solvent for said organic compound (a) in which components (a) and (b) are dissolved or suspended, which solvent does not dissolve the salt of (b) in the absence of the organic compound of (a), and (d) an organic material capable of forming a salt with a metal base which organic material is soluble in said reaction medium present in a catalytic amount of up to about 25 percent by weight of the organic compound (a).

45. A composition comprising:

(a) an organic compound comprising at least one hydrocarbyl group containing in total at least 6 non-aromatic carbon atoms or at least 10 carbon atoms which comprise an aromatic structure, and a polar group containing at least one nitrogen, oxygen, or sulfur atom, said compound being free from acidic hydrogen atoms and from functional groups which provide such organic compounds with acidic hydrogen atoms upon hydrolysis, (b) a finely divided metal salt of a low molecular weight acidic material or a sulfurized derivative thereof, present in stoichiometric excess of the number of nitrogen, oxygen, and sulfur atoms in said organic compound (a), (c) an inert organic solvent for said organic compound (a) in which components (a) and (b) are dissolved or suspended, which solvent does not dissolve the salt of (b) in the absence of the organic compound of (a), and (d) an organic material capable of forming a salt with a metal base which organic material is soluble in said reaction medium, present in a catalytic amount of up to 6 percent by weight of the organic compound (a).

46. The composition of claim 45 wherein the metal salt is a sodium, potassium, lithium, magnesium, calcium, zinc, or cadmium salt, said composition further comprising (e) an additional portion of organic compound capable of forming a salt with said metal base, which is soluble in said reaction medium, such that the amounts of components (d) and (e) are together 6 to 9 percent by weight of the organic compound (a).

47. A composition comprising:

(a) an organic compound comprising at least one hydrocarbyl group containing in total at least 6 non-aromatic carbon atoms or at least 10 carbon atoms which comprise an .aromatic structure, and a polar group containing at least one nitrogen, oxygen, or sulfur atom, said compound being free from acidic hydrogen atoms and from functional groups which provide such organic compounds with acidic hydrogen atoms upon hydrolysis, (b) a finely divided metal salt of a low molecular weight phosphorus acid or anhydride, present in stoichiometric excess of the number of nitrogen, oxygen, and sulfur atoms in said organic compound (a), (c) an inert organic solvent for said organic compound (a) in which components (a) and (b) are dissolved or suspended, which solvent does not dissolve the salt of (b) in the absence of the organic compound of (a), and (d) a catalytic amount of an organic material capable of forming a salt with a metal base, which organic material is soluble in said reaction medium.

* * * * *